United States Patent [19]

Ide

[11] Patent Number: 4,594,958

[45] Date of Patent: Jun. 17, 1986

[54] PRESSER FOOT LIFT DEVICE FOR A TOP FEED SEWING MACHINE

[75] Inventor: Hiroshi Ide, Tokyo, Japan

[73] Assignee: Tokyo Juki Industrial Co. Ltd, Chofu, Japan

[21] Appl. No.: 696,729

[22] Filed: Jan. 31, 1985

[51] Int. Cl.[4] ..... D05B 27/04; D05B 29/02

[52] U.S. Cl. ..... 112/320; 112/311

[58] Field of Search ..... 112/311, 320, 237

[56] References Cited

U.S. PATENT DOCUMENTS

| | | | |
|---|---|---|---|
| 3,437,062 | 4/1969 | Hacklander | 112/320 |
| 3,570,426 | 3/1971 | Kunes | 112/320 |
| 4,503,794 | 3/1985 | Ishihara et al. | 112/320 X |

*Primary Examiner*—Werner H. Schroeder
*Assistant Examiner*—Andrew M. Falik
*Attorney, Agent, or Firm*—Yount & Tarolli

[57] ABSTRACT

A presser foot lift device for an upper feed sewing machine is so arranged that an upper feed tooth is initially lifted and then lifted along with a presser foot only after the lower surface of the upper feed tooth is at a position above the upper surface of the presser foot. This two-step lifting motion is made feasible by the combined operation of an elongated slot formed in a manually rotated actuating arm and a pin formed on an actuator pivotally mounted in coaxial fashion on a supporting shaft of the actuating arm and so adapted as to be introduced into the elongated slot.

8 Claims, 12 Drawing Figures

PRESSER FOOT LIFT DEVICE FOR A TOP FEED SEWING MACHINE

TECHNICAL FIELD

This invention relates in general to a presser foot lift device for an upper feed sewing machine and, more particularly, to such device wherein an upper or upward feed tooth is initially lifted and then raised along with a presser foot only after the lower surface of the feed tooth has attained a position above the upper surface of the presser foot.

PRIOR ART

A lift device for an upper feed sewing machine is known in which an upward feed arm having an upper feed tooth at the end thereof and a presser arm having a presser foot at the end thereof are rotated simultaneously in association with depression of a pedal or the like for lifting the feed tooth and the presser foot by an equal distance (U.S. Pat. No. 1,995,945). The upper feed tooth and the presser foot are lifted simultaneously, with the lower surface of the upper feed tooth projecting down from the lower surface of the presser foot. A cloth tends to be caught at such time by the projecting lower surface of the feed tooth, thus complicating the sewing operation. Usually, a hemstitch sewing machine is provided with a mechanism whereby the presser arm carrying the cloth presser foot is supported on the machine frame for rotation about the vertical axis to deviate the presser foot laterally of the sewing zone. Thus, when the feed tooth and the presser foot are lifted by an equal distance during the hole-up operation, the presser arm cannot be turned horizontally unless means are provided for lowering only the presser arm prior to horizontal rotation thereof, so as to prevent the presser foot from engaging with the upper feed tooth. The result is a complicated operation and a marked decline in operating efficiency.

To eliminate this drawback, it is also known to have the feed tooth and the presser foot shifted relative to each other in the cloth feed direction (U.S. Pat. 3,636,899). However, in such case, the cloth tends to be supported only loosely by the feed tooth during the cloth feeding operation, thus giving rise to an inaccurate cloth feed operation.

SUMMARY OF THE INVENTION

It is therefore an object of the present invention to provide a presser foot lift device for an upper feed sewing machine of the type in which the upper feed tooth is arranged within a slot formed in the presser foot, wherein the device is so constructed that the upper feed tooth and the presser foot do not interfere with a predetermined operation.

It is another object of the present invention to provide a presser foot lift device for an upper feed sewing machine wherein the upper feed tooth is initially lifted and then lifted along with the presser foot but only after the lower surface of the tooth is at a position above the upper surface of the presser foot.

It is a further object of the present ivention to provide a presser foot lift device for an upper feed sewing machine wherein the timing for simultaneous lifting of the tooth and the presser foot is adjustable.

These objects of the present invention are attained by a presser foot lift device for an upper feed sewing maching comprising: a needle plate;

a presser arm supported by a machine frame for rotation about a horizontal axis perpendicular to a cloth feed direction, the presser arm being resiliently urged towards the needle plate at all times;

a presser foot secured to a distal end of the presser arm;

an upper feed arm rotatable about an axis parallel to a rotational axis of the presser arm and reciprocable in the cloth feed direction in operative association with a spindle of the sewing machine;

an upper feed tooth secured to a distal end of the upward feed arm in proximity to the presser foot;

a rocking mechanism for vertically shifting the distal end of the upper feed arm in operative association with the spindle;

an actuating arm rotatably supported about a rotational axis of the presser arm and rotatable by a manual manipulating member;

connecting means arranged between the actuating arm and the upper feed arm for lifting the upward feed tooth above the presser foot in association with rotation of the actuating arm; and actuating means operatively associated with the actuating arm and presser arm adapted for providing interengagement and connection at an operational angle of the actuating arm corresponding to the lifting of the upper feed tooth above the presser foot.

According to a preferred embodiment of the present invention, the presser foot is provided with two rows of slots parallel to the cloth feed direction, the upper feed tooth being insertable into the slots.

According to another preferred embodiment of the present invention, the actuating means comprises a pin provided on an actuating member supported for rotation about the rotational axis of the actuating arm, and an elongated slot provided in the actuating arm.

According to a further embodiment of the present invention, means are provided for adjusting the relative position between the pin and the slot at an initial position, whereby the time at which the upper feed tooth and the presser foot start to be rotated simultaneously may be adjusted. Such adjustment means may comprise a screw which is screwed into the frame, the screw having a distal end for regulating movement of the manual manipulating member.

According to a further embodiment of the present invention, the presser arm is horizontally rotatable about an axis perpendicular to both the cloth feed direction and to a horizontal axis perpendicular thereto.

PREFERRED EMBODIMENTS OF THE INVENTION

Figure 1:
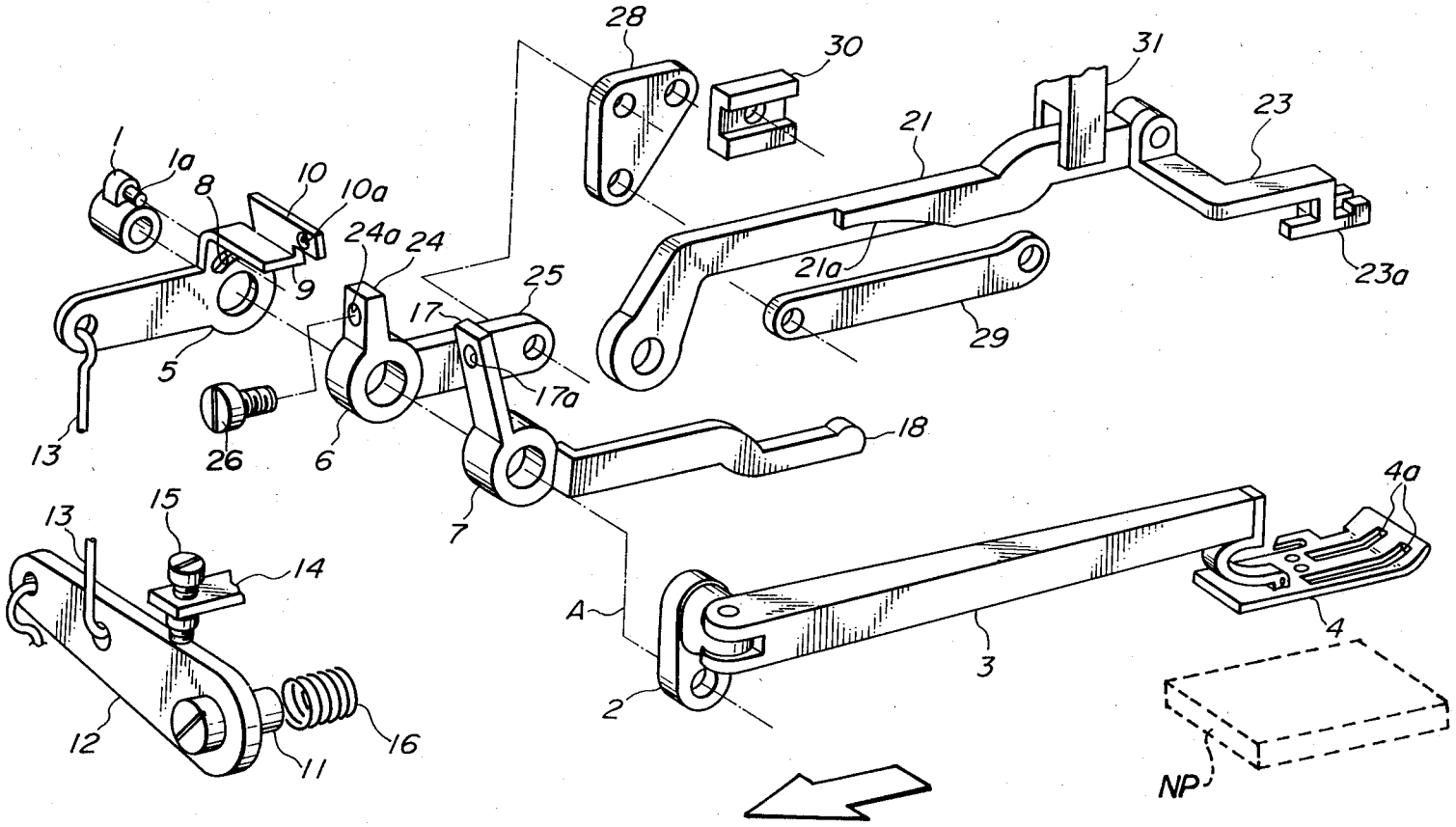
FIG. 1 is an exploded perspective view showing the presser foot lift device for an upper feed sewing machine according to the present invention.

Referring to FIG. 1, there is shown in a perspective view a presser foot lift device for an upper feed of a sewing machine according to the present invention. In the present embodiment, a supporting shaft, not shown, having a horizontal axis A (FIG. 1) perpendicular to a cloth feed direction, indicated by the arrow in FIG. 1 has its central portion mounted by a bearing, not shown, for rotation relative to the frame of the sewing machine, while an actuator 1 having a pin 1*a* parallel to the axis A is securely attached to one end of the supporting shaft A. Attached securely to the other end of the supporting shaft is a holder 2, the upper end of which carries a presser arm 3 for rotation about a vertical axis. The distal end of the presser arm 3 supports a presser foot 4 formed to include two rows of slots 4*a* so that the foot 4 can be rotated about a horizontal line intersecting the cloth feed line. The presser foot 4 is positioned in the sewing area above and opposite to feed teeth, not shown. Mating with the slots 4*a* of the presser foot 4 is a tooth 23*a* of an upward feed tooth member 23 described below. The presser arm 3 is placed under a resilient force constantly pressuring the presser foot 4 onto a needle plate, indicated schematically in dashed lines in FIG. 1 at NP.

An actuating arm 5, a supporting arm 6 and a connecting arm 7 are supported for rotation on the supporting shaft journalled in the bearing.

The base end of the actuating arm 5 has an elongated arcuate slot 8 centered on the axis A of the supporting shaft, and a pin 1*a* of the member 1 is loosely engaged in the slot 8. The actuating arm 5 also has a projection 9 extending from the upper portion of the base end and facing the upper portion of the connecting arm 7. One side edge of the projection 9 is bent upward to form a connecting portion 10 in which a screw hole 10*a* is tapped substantially along the feed cloth direction.

The base end of an operating lever 12 is securely attached to a supporting shaft 11 which in turn is rotatably supported by the frame of the sewing machine and along the cloth feed direction. The distal end of the operating lever 12 is connected to an actuating member, such as pedal, not shown, and the central portion of the lever 12 is connected to the distal end of the actuating arm 5 via connecting rod 13. A screw 15 is adjustably screwed into a horizontal supporting plate 14 affixed to the sewing machine frame so that the distal end of the screw is engaged with the upper edge of the operating lever 12 for setting the initial position of the lever 12. A coil spring 16 is wound about the supporting shaft 11 for resiliently urging the operating lever 12 into partial rotation until the upper edge of the lever 12 is engaged with the end of the screw 15.

Figure 2:
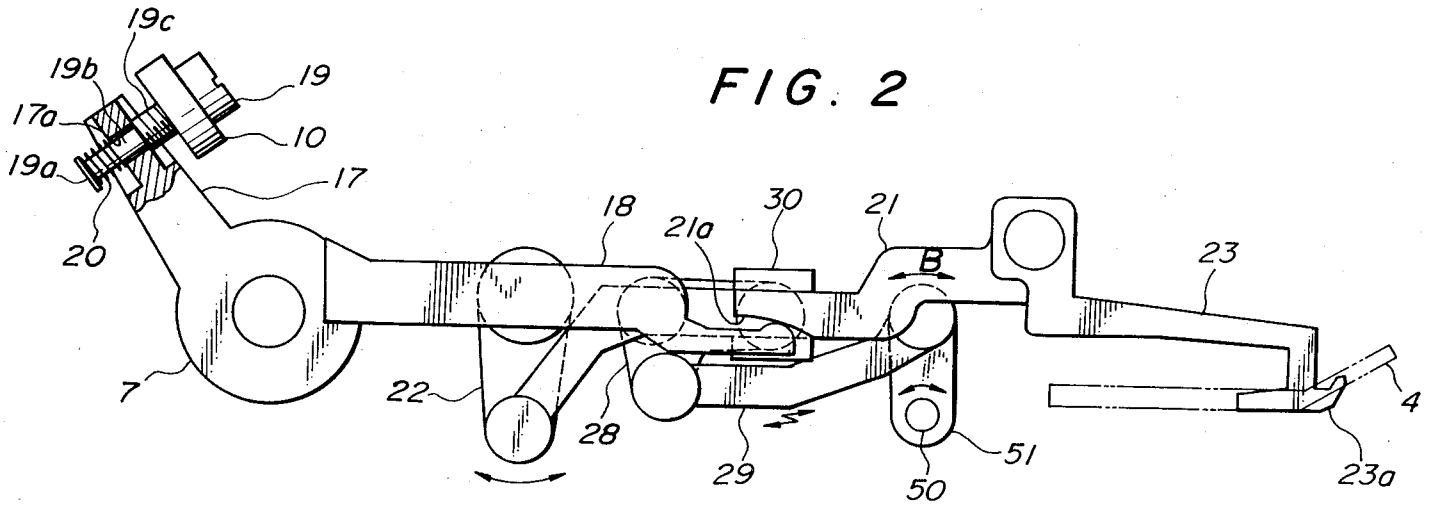
FIG. 2 is a front view showing a lifting mechanism for an upper feed arm of the upward feed device.
Figure 3:
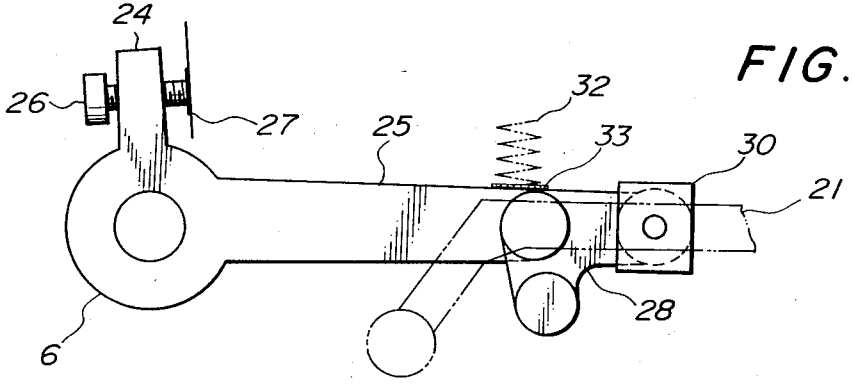
FIG. 3 is a front view showing a rocking mechanism of the upper feed device.

The connecting arm 7 has an upwardly extending connecting portion 17 and a substantially Z-shaped actuating portion 18 extending along the cloth feed direction. Formed in the connecting portion 17 is a through-hole 17*a* facing the connecting portion 10 of the arm 5 and providing communication with the screw hole 10*a*. Referring to FIG. 2, a stepped screw 19 has a peripherally enlarged receiving end part 19*a*, a shank part 19*b* loosely fitted in the through-hole 17*a* of the connecting arm 17, and a threaded base end part 19*c* larger in diameter than the shank 19*b* and screwed into the screw hole 10*a* of the actuating arm 5. Fitted around the shank 19*b* and intermediate the end faces of the receiving part 19*a* and the connecting part 17 is a coil spring 20. The connecting arm 7 and the actuating arm 5 may thus be rotated in unison because the connecting part 17 is embraced by the end face of the threaded part 19*c* and the coil spring 17.

An upward feed arm 21 is rotatably connected to the lower end of a horizontal oscillating or pivot arm 22 at the rear edge of the arm 21 when seen in the cloth feed direction. The pivot arm 22 is oscillated in operative association with the main shaft (not shown) of the sewing machine about an axis intersecting the cloth feed direction. The upper feed tooth member 23 is mounted at the distal end of the upper feed arm 21 in such a manner that tooth 23*a* faces the slot 4*a* of the presser foot 4. Formed on an intermediate side face of the upper feed arm 21 is a guide cam 21*a* consisting of a cam surface engageable with the upper end of the actuating portion 18 of the connecting arm 7. The cam surface of the cam 21*a* is so profiled that the lift of the upper feed tooth member 23 caused by rotation of the connecting arm 7 as later described is always constant with respect to the rotational angle of the connecting arm 7 in any oscillating position of the arm 22 and thus in any horizontal position of the upward feed arm 21.

The supporting arm 6 has an upward projection 24 and a supporting portion 25 extending in the direction opposite to the cloth feed direction and connected to a vertical oscillating mechanism described below. The rotational position of the arm 6 is regulated by a screw 26 screwed into a tapped hole 24*a* formed in the projection 24 in the cloth feed direction so that the distal end of the screw is engaged with the sewing machine frame. A buffer sheet 27 formed of rubber or a like material is secured to the machine frame in opposition to the end of the screw 26 and acts to cushion strong impact of the end portion of the screw 26 against the frame during pivoting of the supporting arm 6.

A rocking member 28 connected to the distal end of the supporting portion 25 of the supporting arm 6 for rotation about an axis intersecting the cloth feed direction is rotatably connected to the end of a pivot link 29 (connecting means) at a position beneath its rotational axis so that the rocking member 28 may be turned about an axis parallel to this rotational axis. The rocking member 28 also carries a holding member 30 at a position spaced from the rotational axis in the direction opposite the cloth feed direction so that the member 30 may be turned about an axis parallel to the rotational axis. The pivot link 29 has its base end connected via a link 51 to a knife driving shaft 50 oscillated in operative association with the spindle of the sewing machine, with the oscillation taking place in the direction of the arrow A in FIG. 2. The holding member 30 is substantially U-shaped in longitudinal section so as to accommodate the upper and lower sides of the intermediate portion of the upper feed arm 21. The rocking member 28, pivot link 29 and holding member 30 construct a vertical rocking mechanism.

A bifurcated guide member 31 secured to the sewing machine frame is slidably mounted for holding both sides of the end portion of the upper feed arm 21. An adjustment member 32 is engaged with the upper distal end of the supporting portion 25 of the supporting arm 6 for adjustment of the downwardly acting spring force. A sheet 33 consisting of rubber or the like is provided at an engaging portion between the adjustment member 32 and the supporting portion 25.

Although not shown, the connecting hole in the link 51 for the driving shaft 50 may be elongated for adjusting the connecting position so as to provide for an adjustable stroke of oscillation.

The above-described vertical oscillating mechanism operates as follows: When the pivot arm 22 is pivoted with its upper end as the fulcrum, the upward feed arm 21 is swung horizontally. Also, when the pivot link 29 is reciprocated as shown by the arrow B, the rocking member 28 is rocked about the point of connection with the supporting portion 25 of the supporting arm 6, so that the upper feed arm 21 and the holding member 30 supported by the rocking member 28 are oscillated vertically. The upper feed arm 21 is caused to perform socalled "four-feed motion" as a result of these combined vertical and horizontal movements. The upper feed tooth member 23 is lifted when a step such as a thickened cloth portion is moved into a position between the presser foot 4 and the needle plate. However, since the rocking member 28 holding the holding member 30 which supports the upper feed arm 21 is rotatably supported in the supporting portion 25 of the supporting arm 6, the latter is turned counterclockwise in FIG. 1 about the axis A of the supporting shaft against the force of the adjustment member 32 to absorb the lifting force. After passage of the cloth portion of increased thickness, as the supporting arm 6 is returned to its original position, the distal end of the screw 26 screwed into the supporting arm 6 tends to strike the frame while the adjustment member 32 tends to impact against the supporting portion 25. However, the oscillation or noise is minimized through the medium of the buffer sheets 27, 33 provided between these impact portions.

The supporting shaft is subjected to a rotational force in the clockwise direction in FIG. 1 owing to the resilient force acting on the presser arm 3 for pressuring the presser foot 4 onto the needle plate. The hook or tooth 23*a* of the upper feed tooth member 23 is pressed against the needle plate under the spring force of the adjustment member 32 acting on the end of the supporting portion 25 of the supporting arm 6 and via the upper feed arm 21 engaging the supporting arm 6. Also, since the spring 20 of the stepped screw 19 is mounted under compression between the receiving portion 19*a* and the connecting portion 17, the connecting arm 7 is resiliently urged clockwise in FIG. 2 so that the actuating portion 18 is normally kept apart from the cam surface of the guide cam 21*a*.

Figure 4:
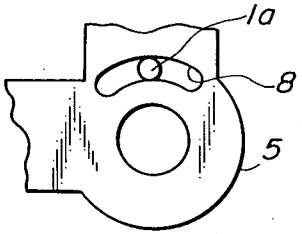
FIGS. 4 through 6 are views for describing the connection between an actuating arm and a supporting shaft.

When the presser foot 4 is pressed against the needle plate and the upper feed tooth member 23 lowered, the supporting shaft and the actuating arm 5 are brought to an initial position in which the pin 1*a* is positioned at the center of the arcuate opening 8 (FIG. 4). This position of the pin 1*a* (FIG. 4) is so set that the distance to the right extremity of the slot 8 corresponds to the lift of the upper feed arm 21 that is required for the lower end face of the tooth 23*a* of the upper feed tooth member 23 to clear the upper end face of the presser foot 4. The distance between the pin 1*a* and the right extremity of the slot 8 in the initial position can be adjusted by virtue of the fact that the actuating arm 5 can be rotated via the operating lever 12 by adjustment of the screw 15 for regulating the operating lever 12.

Figure 5:
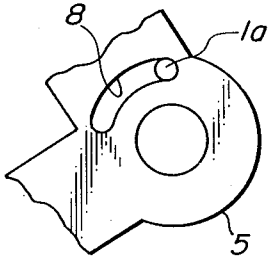
Figure 6:
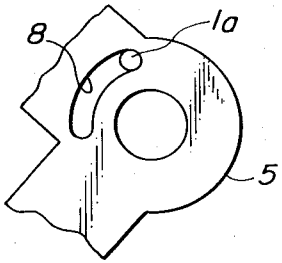
Figure 7:
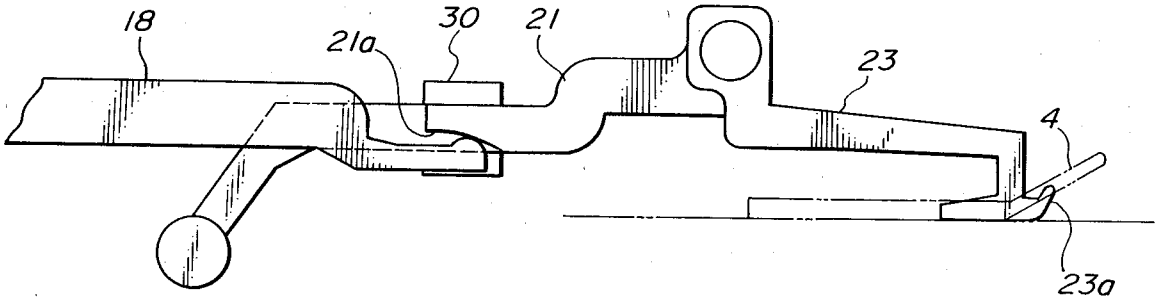
FIGS. 7 to 9 are views for describing the lifting mechanism of the upper feed arm corresponding to FIGS. 4 to 6, respectively.
Figure 8:
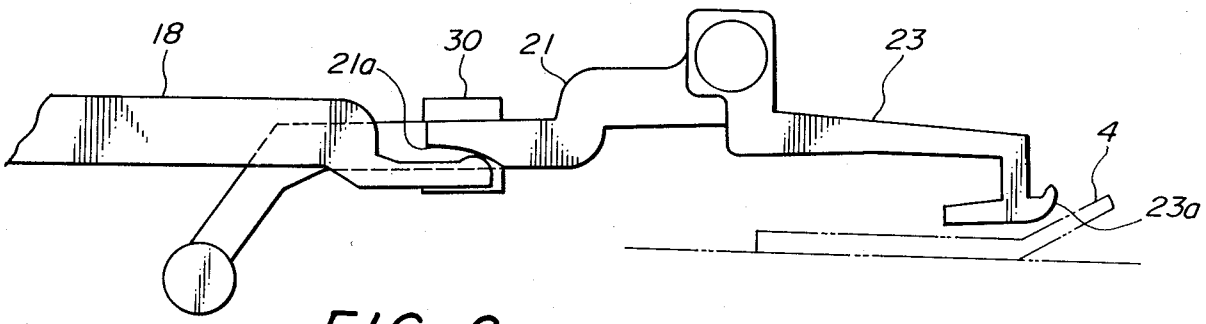
Figure 9:
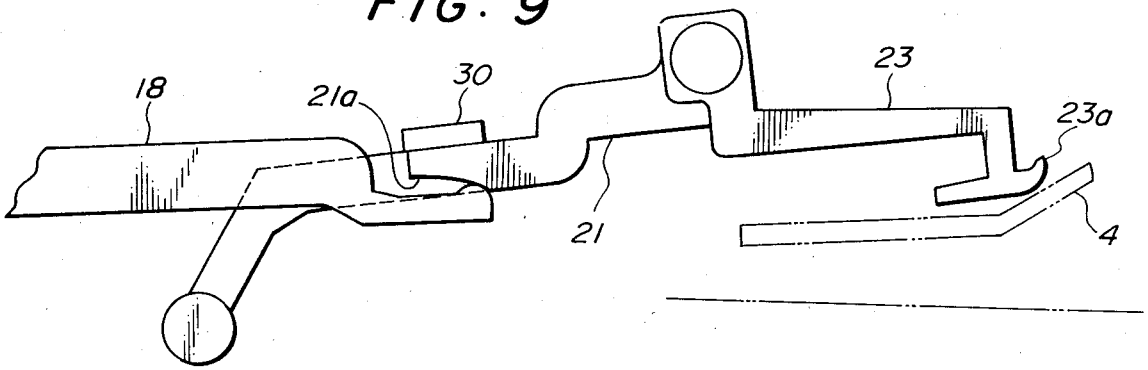

When the operating lever 12 is turned against spring 16 by depression of an operating member such as a pedal, the actuating arm 5 is turned counterclockwise in FIG. 1 with the axis A of the supporting shaft as center. The actuating arm 5 and the connecting arm 7 are connected at 10, 17 to each other so that these arms are rotated substantially simultaneously, whereby the actuating portion 18 engaged with the guide cam 21*a* is caused to lift the feed arm 21, which is rotated about the axis of connection with the pivot arm 22 in such a manner that the distal end thereof is raised. The result is that the tooth 23*a* of the upper feed tooth member 23 is raised above the needle plate. During the initial stage of rotation of the actuating arm 5, no operating force is transmitted to the supporting shaft so that the latter remains stationary. As the right side of the slot 8 approaches the pin 1*a* through rotation of the actuating arm 5, the lower end face of the tooth 23*a* of the upper feed tooth member 23 is raised to a level higher than the upper end face of the presser foot 4 (FIG. 8). As the pin 1*a* engages the right side face of the slot 8 (FIG. 5), the actuator 1 (supporting shaft) is connected to the actuating arm 5 for rotation in unison therewith. The presser arm 3 is rotated in unison with and around the supporting shaft to raise the presser foot 4 away from the needle plate (FIGS. 6 and 9). It should be noted that the profile of the guide cam 21*a* engaging the actuation part 18 of the connecting arm 7 is so selected that the lift of the upper feed tooth 23 during the initial rotation of the connecting arm 7 remains constant irrespective of a change in the pivotal position of the pivot arm 22.

Figure 10:
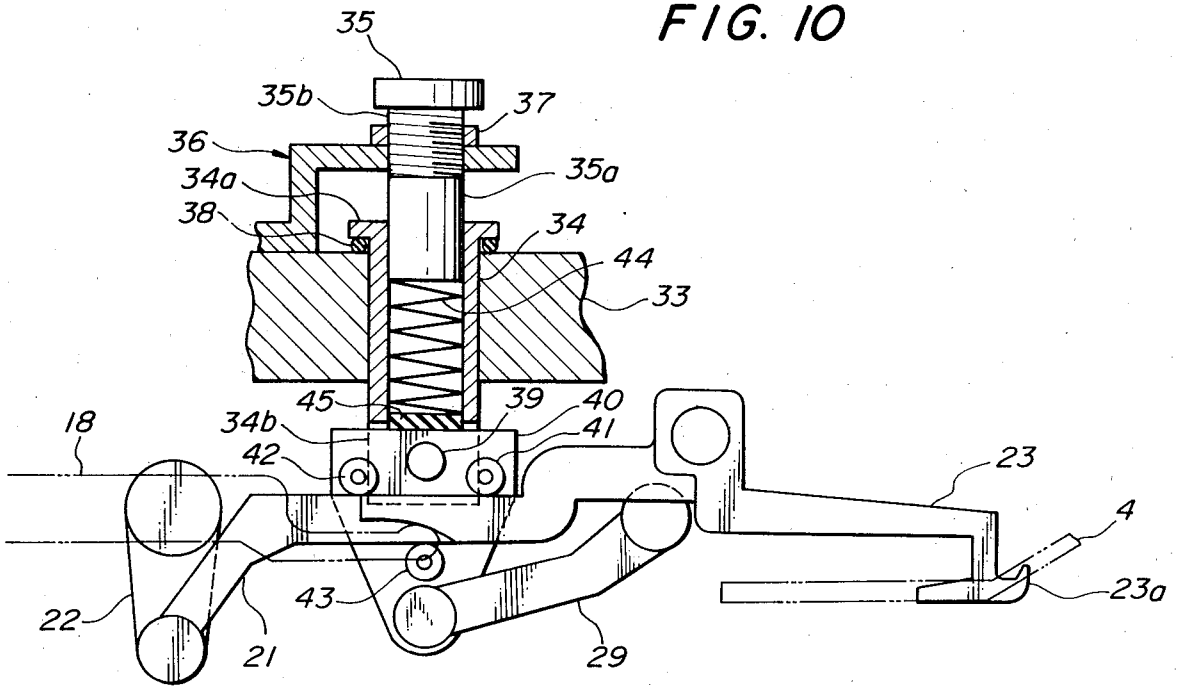
FIG. 10 is a front view of the upper feed device according to a second embodiment of the present invention.
Figure 11:
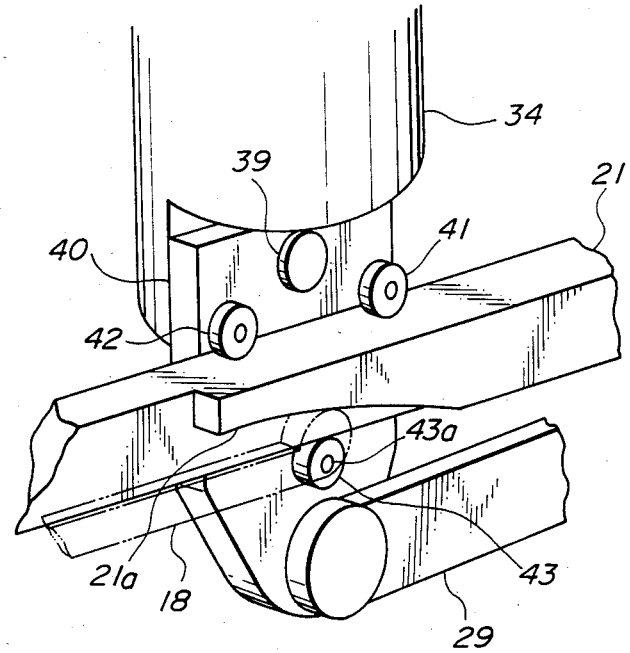
FIG. 11 is a perspective view showing essential parts shown in FIG. 10.

Referring to FIGS. 10 and 11, there is shown a second embodiment of the rocking mechanism according to the present invention. The rocking mechanism comprises a frame 33 of the sewing machine, a tubular holding member 34 supported on the frame 33 for vertical sliding motion but not for rotation and having at its upper end a radially outwardly extending step 34*a* and at its base end a supporting surface 34*b* which has a cut-out along a line substantially passing through the axis, an adjustment shaft 35 having at its base end a shaft portion 35*a* loosely engaged with the upper end of the holding member 34 and at its upper end a threaded portion 35*b*, a rest 36 secured at the base thereof to the frame 33 and screwed at the distal end thereof onto the threaded portion 35*b* of the adjustment shaft 35, a nut 37 screwed onto the threaded portion 35*b* above the rest 36, and a buffer member 38 disposed between the step 34*a* of the holding member 34 and the frame 33. A supporting shaft 39 secured to the supporting surface 34*b* has an axis intersecting the fabric feed direction substantially on the axis of the holding member 34. An rocking member 40 has an upper extremity rotatably supported about the shaft 39 and a lower extremity rotatably connected to the pivot link 29. Rollers 41, 42 are spaced apart from each other along the cloth feed direction on both sides of the supporting shaft 39 and are rotatably supported with respect to the rocking member 40 and about the axis parallel to shaft 39 as center so as to be engageable with the upper edge of the upper feed arm 21. A roller 43 is engageable with the lower face of the upper feed arm 21 and rotatably supported with respect to the rocking member 40 substantially on the axis of the holding member 34 and with the axis parallel to the shaft 39 as center.

A coil spring 44 is mounted under compression within the holding member 34 between the lower end of the adjustment shaft 35 and the upper end of the rocking member 40 via a buffer member 45. Note that the supporting arm 6 may be dispensed with in the present embodiment.

The above-described rocking mechanism operates as follows: As the pivot arm 22 performs oscillating movement, the upper feed arm 21 is reciprocated horizontally under guidance of the rollers 41, 42 and 43. As the pivot link 29 performs oscillating movement, the rocking member 40 is rocked about shaft 39, so that the upper feed arm 21 embraced by the rollers 41, 42 and 43 is reciprocated vertically and the upward feed tooth member 23 of the upper feed arm 21 is caused to perform so-called "four-feed motion". When the thickened portion of the cloth reaches the tooth 23*a* of the upper feed tooth member 23, the latter is lifted but the rocking member 40 raises the holding member 34 against spring 44 through the medium of the rollers 41, 42 engaging the upper feed arm 21, thus making possible rotation of the upper feed arm 21. When the feed arm 21 is returned after passage of the thickened portion of the cloth, a collision might be expected to take place between the member 34 and the frame 33 on one hand and between the spring 44 and the member 40 on the other. However, this collision and the consequent oscillation and noise are prevented or minimized by the intervening buffer members 38, 45. On the other hand, during the upward stroke of the holding member 40, the upward feed arm 3 (or upward feed tooth member 23) is lifted a predetermined distance in advance of the lifting of the presser arm 3 (or presser foot 4) through the medium of the actuating portion 18 of the connecting arm 7 engaging the guide cam 21*a*.

Figure 12:
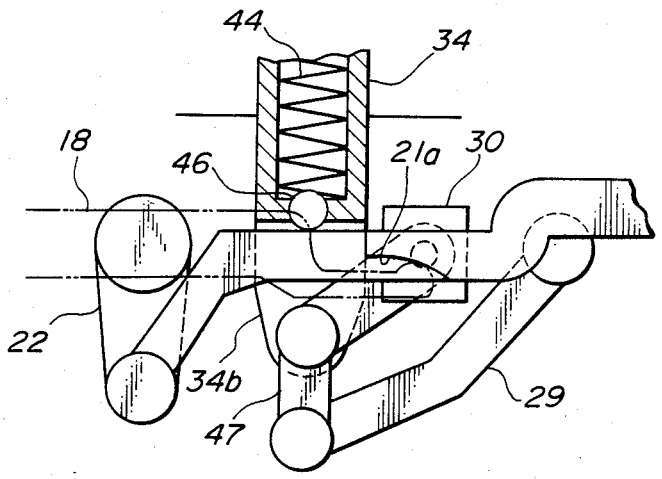
FIG. 12 is a perspective view showing essential parts of the upper feed device according to a third embodiment of the present invention.

Referring to FIG. 12, there is shown a third embodiment of the rocking mechanism according to the present invention. In the present embodiment, the supporting surface 34*b* at the base end of the holding member 34 is extended downward and an intermediate portion of an L-shaped connecting link 47 is rotatably connected to the lower end of the surface 34*b*. A roller 46 engageable with the upper edge of the upward feed arm 21 is mounted on the holding member 34 for rotation about an axis intersecting the fabric feed direction. The distal end of the link 29 is rotatably connected to the lower end of the connecting link 47, and the holding member 30 fitted on the feed arm 21 (and arranged in a manner similar to that of the holding member according to the second embodiment) is rotatably supported by the upper end of the connecting link 47.

The above-described rocking mechanism operates as follows: As the pivot arm 22 performs oscillating movement, the upward feed arm 21 is reciprocated horizontally by the holding member 30 and, as the link 29 performs oscillating movement, the holding member 30 is reciprocated vertically via the connecting link 47, thus causing vertical movement of the upper feed arm 21. This causes the so-called "four-feed motion" of the upper feed tooth member 23, just as in the above-described embodiment. When the thick portion of the cloth has been advanced to the tooth 23*a* of the upper feed tooth 23, this portion off the cloth causes the upper feed member 23 to be lifted. However, the holding member 34 is lifted by the roller 46 against the spring 44, thus lifting the upward feed arm 21.

Also, when the holding member 34 is lifted, the upper feed arm 21 (upper feed tooth member 23) is lifted a predetermined amount in advance of lifting of the presser arm 3 (presser foot 4), this being accomplished by the actuating portion 18 of the connecting arm 7 engaging the guide cam 21, as described hereinabove.

In the present embodiment, the supporting arm 6 and the connecting arm 7 are supported by the bearing which rotatably supports the intermediate portion of the supporting shaft, while the actuating arm 5 and the holder 2 are secured to both ends of the supporting shaft. However, it is also possible for the actuating arm 5 and the holder 2 to be secured to both ends of the supporting shaft, and for the arms 6 and 7 to be rotatably supported directly by the supporting shaft.

Further, in the present embodiment, the actuating arm 5, supporting arm 6, connecting arm 7 and the holder 2 supporting the presser arm 3 are all supported on the axis A of the supporting shaft. However, it is possible for the arms 6 and 7 to be supported on a separate shaft having an axis parallel to the supporting shaft for rotation in unison with rotation of the actuating arm 5.

Also, in the present embodiment, the guide cam 21*a* is provided on the upward feed arm 21 for engaging with the end of the actuating portion 18 of the connecting arm 7. However, it is possible for the roll engaging with the guide cam 21*a* to be rotatably supported at the end of the actuating portion 18, or for the upper surface at the distal end of the actuating portion 18 be profiled as a cam similar to the guide cam and for the roller or pin to be provided on the engaging portion of the upper feed arm 21.

Moreover, in the present embodiment, the actuator 1 is secured to the supporting shaft and the pin 1*a* of the actuator 1 is shown to be engaged in the elongated slot 8 of the actuating arm 5. It is however possible for the actuating arm 5 to be loosely mounted on the supporting shaft adjacent to the holder 2, and for a pin to be provided to extend axially from the holder and into the elongated slot 8 of the actuating arm 5. It is also possible for the slot to be provided in the actuator 1 or in the holder 2, and for the pin to be formed on the actuating arm 5, whereby results similar to those described hereinabove may be obtained.

Also, in the present embodiment, the actuating portion 18 of the connecting arm 7 is engaged with the upper feed arm 21 to cause rotation of the supporting arm 6 about the axis A of the supporting shaft via the upper feed arm 21 for lifting the upper feed tooth member 23. However, it is possible for the actuating portion 18 be engaged with the lower distal end face of the supporting portion 25 of the supporting arm 6 to cause direct rotation of the supporting arm 6 and lifting of the upper feed tooth member 23 via the upper feed arm 21.

According to the present invention as described above, there is provided an arrangement comprising the actuating arm 5 supported at its base end for rotation about a rotational axis of the presser arm and connected to the manual manipulating member at a distal end spaced horizontally from the base end, connecting means arranged between the actuating arm and the upper feed arm for lifting the upward feed tooth member from the needle plate as a result of rotation of the actuating arm, and actuating means or the combination of the pin 1*a* and the slot 8 operatively associated with the actuating arm and the presser arm and engaged with each other at a rotational angle of the actuating arm that corresponds to the lifting of the upper feed tooth member to a position above the presser foot, wherein the upper feed tooth member is lifted before the lifting of the presser arm by the operation of the actuating member, the presser foot being connected to the manipulating member and starting to be lifted only after the upper feed tooth member is lifted to a position at which the lower surface of the upper feed member is above the upper surface of the presser foot. The feed member is thus always at a position above the lower surface of the presser foot so as not to interfere with the introduction or extraction of the cloth into or out of the sewing zone. In addition, since the upper feed tooth member is located above the presser foot, the presser arm can be rotated horizontally without requiring that the presser foot being lowered. The result if higher operational efficiency.

What is claimed is:

1. A presser foot lift device for an upper feed sewing machine, comprising:

a presser arm supported for rotation about an axis perpendicular to a cloth feed direction;

a presser foot secured to an end portion of said presser arm;

a feed arm rotatable about an axis parallel to a rotational axis of said presser arm and reciprocable in the cloth feed direction;

a feed tooth secured to an end portion of said feed arm in proximity to said presser foot;

a rocking mechanism for reciprocating said feed arm during operation of the sewing machine;

an actuating arm supported for rotation about the rotational axis of said presser arm;

connecting means arranged between said actuating arm and said feed arm for rotating said feed arm to lift said feed tooth above said presser foot during initial rotation of said actuating arm; and actuating means connected with said actuating arm and presser arm for rotating said presser arm with said feed arm to simultaneously lift said feed tooth and presser foot with said feed tooth disposed above said presser foot during continued rotation of said actuating arm.

2. The device according to claim 1, wherein said presser foot is provided with two rows of slots parallel to the cloth feed direction and said upward feed tooth is insertable into said slots.

3. The device according to claim 1, wherein said actuating means comprises a pin provided on an actuator member supported for rotation about the rotational axis of said actuating arm, and an elongated slot provided in said actuating arm.

4. The device according to claim 3, further comprising means for adjusting the relative position between the pin and the slot to adjust the time at which said upper feed tooth and said presser foot start to be lifted simultaneously is capable of being adjusted.

5. The device according to claim 1, wherein said presser arm is rotatable about a horizontal axis perpendicular to the cloth feed direction.

6. An apparatus for use in a sewing machine, said apparatus comprising a presser foot, a feed tooth for feeding material to be sewn relative to said presser foot, said feed tooth being movable between a lowered condition in which it extends through an opening in said presser foot to engage material to be sewn and a raised condition in which said feed tooth is disposed above said presser foot, said presser foot being movable between a lowered condition in which it presses against material to be sewn and a raised condition, and drive means for moving said feed tooth and presser foot from their lowered conditions to their raised conditions with said feed tooth above said presser foot throughout movement of said presser foot, said drive means including means for moving said feed tooth from its lowered condition to its raised condition while said presser foot remains in its lowered condition and means for moving said presser foot and feed tooth together with said feed tooth in its raised condition to prevent interference of said presser foot with material to be sewn.

7. An apparatus as set forth in claim 6 wherein said means for moving said presser foot and feed tooth together includes means for moving said presser foot from its lowered condition to its raised condition and for moving said presser foot from its raised condition to its lowered condition while maintaining said feed tooth above said presser foot.

8. An apparatus as set forth in claim 6 wherein said drive means includes means for maintaining a constant distance between said presser foot and feed tooth during movement of said presser foot from its lowered condition to its raised condition.

* * * * *